US009284146B2

(12) United States Patent
Miravete Guerrero et al.

(10) Patent No.: US 9,284,146 B2
(45) Date of Patent: Mar. 15, 2016

(54) REVOLVER-TYPE WINDING MACHINE FOR STRIP MATERIAL

(75) Inventors: David Miravete Guerrero, Girona (ES); Jordi Prat Gil, Girona (ES)

(73) Assignee: COMEXI GROUP INDUSTRIES, S.A. (ES)

( * ) Notice: Subject to any disclaimer, the term of this patent is extended or adjusted under 35 U.S.C. 154(b) by 160 days.

(21) Appl. No.: 14/119,234

(22) PCT Filed: May 24, 2012

(86) PCT No.: PCT/ES2012/000143
§ 371 (c)(1),
(2), (4) Date: Dec. 17, 2013

(87) PCT Pub. No.: WO2012/164115
PCT Pub. Date: Dec. 6, 2012

(65) Prior Publication Data

US 2014/0110521 A1 Apr. 24, 2014

(30) Foreign Application Priority Data

Jun. 1, 2011 (ES) ..... 201100614

(51) Int. Cl.
*B65H 18/10* (2006.01)
*B65H 18/02* (2006.01)

(52) U.S. Cl.
CPC ..... *B65H 18/10* (2013.01); *B65H 18/021* (2013.01); *B65H 18/028* (2013.01); *B65H 2301/41308* (2013.01); *B65H 2301/41352* (2013.01); *B65H 2301/41394* (2013.01); *B65H 2402/351* (2013.01); *B65H 2402/352* (2013.01); *B65H 2403/42* (2013.01); *B65H 2408/231* (2013.01);

(Continued)

(58) Field of Classification Search
CPC ..... B65H 19/2223; B65H 19/2215; B65H 2402/352; B65H 2408/241
USPC ..... 242/532.4–532.6, 555.5, 559.2
See application file for complete search history.

(56) References Cited

U.S. PATENT DOCUMENTS 5,417,382 A * 5/1995 Petitjean et al. ..... 242/527
5,429,320 A 7/1995 Pack
5,845,867 A * 12/1998 Hould et al. ..... 242/527

(Continued)

FOREIGN PATENT DOCUMENTS

DE 3731748 A1 4/1989
EP 0243748 A2 11/1987

(Continued)

*Primary Examiner* — Sang Kim
(74) *Attorney, Agent, or Firm* — Hess Patent Law Firm LLC; Robert J. Hess

(57) ABSTRACT

The winding machine is intended for plastic, laminated, aluminum, paper and self-adhesive materials and comprises two winding shafts (10, 11) which are each provided with a direct-drive motor (13, 14) and which are mounted on a plate (15) that is rotationally supported with respect to a vertical wall (16*a*) of a framing (16). The plate (15) has associated guides (50, 51) and drive means for moving the motors (13, 14) and shafts (10, 11) linearly with respect to the plate (15). The second end of each winding shaft (10,11) is supported by a carriage (40, 41) that can move in guides (44, 45) provided on a wall (16*b*), each carriage (40, 41) including a clamp (42, 43) that holds the ends of the winding shafts (10, 11) in a horizontal plane during the formation of a reel on any of said winding shafts (10, 11) and as the reel is moved into an unloading position.

11 Claims, 7 Drawing Sheets

(52) U.S. Cl.
CPC ... *B65H 2408/23152* (2013.01); *B65H 2555/10* (2013.01); *B65H 2555/24* (2013.01)

(56) References Cited

U.S. PATENT DOCUMENTS 5,918,830 A 7/1999 Verajankorva et al.
8,727,260 B2 * 5/2014 Oravits et al. ..... 242/533.4
2005/0127231 A1 * 6/2005 Pasquale ..... 242/533.6

FOREIGN PATENT DOCUMENTS

WO WO 2007096916 8/2007
WO WO 2012/164115 A1 12/2012

* cited by examiner

REVOLVER-TYPE WINDING MACHINE FOR STRIP MATERIAL

FIELD OF THE INVENTION

The present invention relates to a revolver-type winding machine (rotational winding shaft-bearing turret structure) intended for plastic, laminated, aluminum, paper and self-adhesive materials, prepared to operate at speeds in the order of 200 to 600 mpm (meters per minute) and with web widths comprised between 520 and 2200 mm.

The winding machine of this invention comprises two parallel winding shafts with independent direct-drive motors, where the reel progressively moves linearly during its formation towards the center of a vertical support plate for supporting the assembly of winding shafts and servomotors, and after formation of the reel, and with the reel located in the center of said plate, the plate rotates and transfers an empty winding shaft to a material receiving position, and the empty reel is subsequently removed by means of another linear movement of the formed reel with respect to said disc-shaped plate.

Said motors for the direct drive of the winding shafts can by synchronous, i.e., servomotors, or asynchronous (alternating current) and equipped in said latter case with a winding for direct drive, although such motors will generally be described hereinafter as servomotors.

The machine has associated cutting means that allow subdividing the formed reel into several units of the same or different widths.

BACKGROUND OF THE INVENTION

The proposed machine has a general structure and corresponds to an operating principle (independent linear movement of the two motor-winding shaft assemblies in relation to a vertical disc-shaped plate that rotates about a horizontal axis and bearing said assemblies) which is generally described in patents EP 243 748 (see FIGS. 7 and 8 and the corresponding part in the description) and U.S. Pat. No. 5,429,320.

The winding machine described in this latter patent U.S. Pat. No. 5,429,320 has all the features described in the preamble of claim 1.

With respect to this winding machine, the invention proposes alternative support means, offering a releasable hold of the free ends of the winding shafts, which are retained at all times, during the formation of the reel in said shafts until the reel is unloaded.

The invention also proposes a different structure of the rotary drive means for the disc-shaped plate entailing increased robustness of the machine and furthermore improving the conditions for supplying and distributing electric power and fluid to the different drive means of the machine, entailing simplification and greater reliability of said supply.

The invention further proposes means for the selective interlocking of the disc-shaped plate bearing the winding shafts during the movement of the reel being formed towards the central part of the plate, which assures movement of the reel being formed towards the center of the bearing disc-shaped plate in a horizontal plane.

DISCLOSURE OF THE INVENTION

The revolver-type winding machine for web material of this invention has a known structure (e.g. according to patent EP 243 748 or patent U.S. Pat. No. 5,429,320) and for that purpose comprises:

- two parallel winding shafts each of which is provided with an independent rotary drive by means of a dedicated electric servomotor, with its output shaft connected directly to a first end of a corresponding winding shaft;
- a disc-shaped support plate bearing said electric servomotors for the rotary drive of the winding shafts and the winding shafts themselves arranged such that they are perpendicular to said plate that is rotationally supported with respect to a circular opening of a vertical wall of a framing of the winding machine;
- rotary drive means of said support plate to cause rotation thereof about a horizontal axis centrally arranged with respect to the disc-shaped plate to alternately arrange the two winding shafts in a loading position next to the web material supply source, said rotation being performed when the formed reel is in a central position with respect to the plate, such that when the disc-shaped plate rotates the reel is in a central position and since it rotates about its own axis, it does not require lifting efforts;
- guiding means and drive means for moving said rotary drive servomotors and winding shafts linearly along said support plate in a plane perpendicular to same, passing through its center (see FIGS. 6 and 7 of EP 243 748);
- support structures for supporting the second end of each of the two winding shafts during at least part of the linear movement thereof and during the formation of a reel in each of them, said support structures being supported on a second vertical wall of said framing, opposite said first vertical wall.

In a machine having these features, the invention proposes that said support structures for supporting the free ends, opposite the rotary drive ends of the winding shafts rest in carriages that can move linearly along parallel pairs of guides, these carriages bearing selectively releasable holding elements comprising pneumatically actuated clamp devices, such that at all times they keep the ends of the winding shafts held in a horizontal plane coplanar with said plane perpendicular to said disc-shaped plate during the formation of a reel, and while said reel advances towards a central position of the plate (movement controlled by a magnetic sensor located on the rotating shaft of a pressure rewinding element) in any one of said winding shafts.

The winding shafts are thus held at the end opposite their direct drive end by means of a double flange clamp arrangement during the movement of the reel being formed towards a central position of the disc-shaped plate and during a subsequent linear movement with respect to said plate progressing towards an unloading position away from the center until the reel is resting on a lifting table, which will remove the formed reel from the winding shaft, which is then arranged in cantilever fashion. Said clamp arrangement opens, releasing the end of the shaft before removing the reel and at the time of rotation of the disc-shaped plate and turret where it releases the end of the empty winding shaft.

According to another feature of the invention, said pairs of guides and carriages are located on the inner face of said second wall of the framing directly facing the ends of the winding shafts.

Another particularity of the invention is the possibility it offers of selectively immobilizing the disc-shaped plate during linear movements of the reel being formed (and its drive servomotor) towards the central part of the disc-shaped plate, whereby assuring that said movements are always made in a perfectly horizontal plane.

Means for supporting the weight of the formed reel in the center of the plate through said disc-shaped plate in the framing while the disc-shaped plate rotates, transferring an empty winding shaft to the loading position, whereby assuring that said movement does not generate over-efforts in means responsible for moving the drive servomotors of the winding shafts have also been provided.

These and other features of the invention will become clearer based on the following detailed description of an embodiment given by way of illustrative and non-limiting example with the aid of the attached drawings.

DETAILED DESCRIPTION OF AN EXEMPLARY EMBODIMENT

Figure 1:
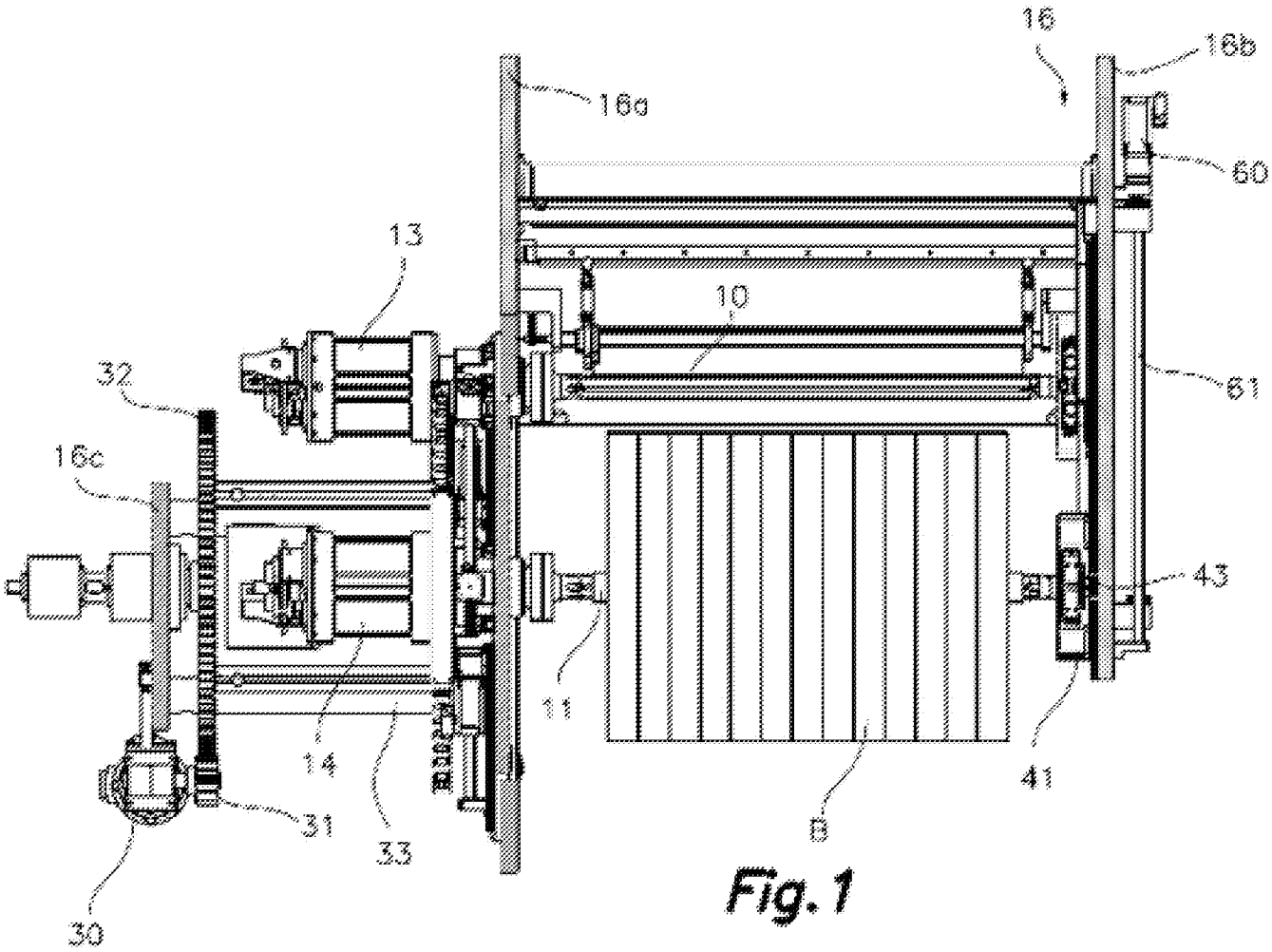
FIG. 1 is a plan view of the winding machine of this invention, showing a reel B already formed on one of the winding shafts and occupying a central position with respect to a disc-shaped plate supporting the winding shafts.

As can be seen in FIG. 1, the proposed revolver-type winding machine for web material comprises two parallel winding shafts 10, 11 each of which is provided with an independent rotary drive servomotor 13, 14 connected directly to a first end of the corresponding winding shaft 10, 11. Said drive servomotors 13, 14 and winding shafts 10, 11, are associated with a disc-shaped support plate 15 with respect to which said winding shafts 10, 11 are arranged in a perpendicular manner. The disc-shaped plate 15 is rotationally supported with respect to a circular opening 17 of a vertical wall 16*a* of a framing 16, and said disc-shaped plate 15 has associated rotary drive means, which will be described below, to cause rotation about a horizontal axis centrally arranged with respect to the plate 15 for the purpose of alternately arranging the winding shafts 10, 11 in a loading position next to the web material supply source.

According to the structure disclosed in aforementioned EP 243748, the disc-shaped plate 15 has associated guiding means 50, 51 (common to the two servomotors 13 and 14) and drive means 52, 53, 54, 55 (linear pneumatic actuator and guide in both cases) for moving said rotary drive servomotors 13, 14 and winding shafts 10, 11 linearly along the support plate 15 in a plane perpendicular to same, passing through its center, i.e., diametrical, such that the reel being formed progressively advances towards the center of said disc-shaped plate 15, and when the disc-shaped plate 15 rotates 180° to arrange the empty winding shaft in the loading position, the reel is supported in the center of the plate 15, avoiding any lifting effort.

As for the second end of each of said winding shafts 10, 11, according to the present invention there is provided a support structure for supporting the shafts 10, 11 during the linear movement thereof and during the formation of a reel on each of said shafts, said support structure being arranged associated with a second vertical wall 16*b* of the framing that is parallel to and opposite the vertical wall 16*a* of the framing. This support structure (one for each winding shaft) comprises a carriage 40, 41 that can move linearly by means of parallel pairs of guides 44, 45, each carriage 40, 41 bearing selectively releasable holding elements equipped with clamp devices 42, 43 such that at all times said clamps keep the ends of the winding shafts 10, 11 held in a horizontal plane coplanar with said plane perpendicular to said plate 15 during the formation of a reel on any one of said winding shafts 10, 11. Each of said clamps devices 42, 43 is provided with an autonomous drive actuator (pneumatic piston or cylinder) 46.

As previously indicated, the pairs of guides 44, 45 and carriages 40, 41 being located on the inner face of the wall 16*b* of the framing 16 directly facing the ends of the winding shafts 10, 11 is also characteristic of the proposal of this invention. Such arrangement of the support-holding means for supporting-holding the ends of the shafts assures the parallelism of the winding shafts 10, 11 and the correct holding thereof at all times during the operating cycle of the winding machine. Said holding is compatible with the rotation of the shaft, for which purpose the clamp means have been provided with rolling coupling means for the coupling with the end of each shaft 10, 11. Furthermore the fact that each of the winding shafts 10, 11 is always held at its two ends allows assuring perfect alignment of said shafts perpendicular to the disc-shaped plate 15.

Figure 2:
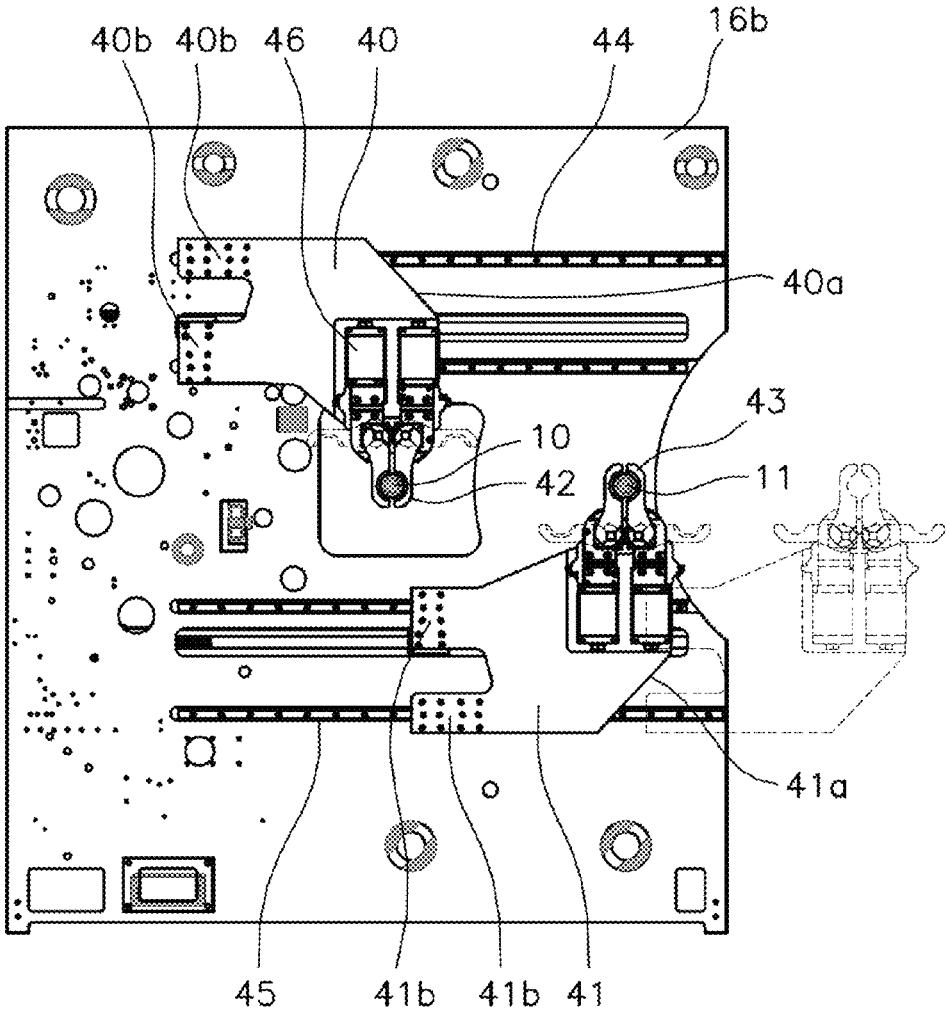
FIG. 2 is an elevational view of the inner face of one of the walls of the framing where the support and holding means for supporting and holding the ends of the winding shafts are located, one of the bearing carriages being shown in its end position by means of dotted lines.
Figure 3:
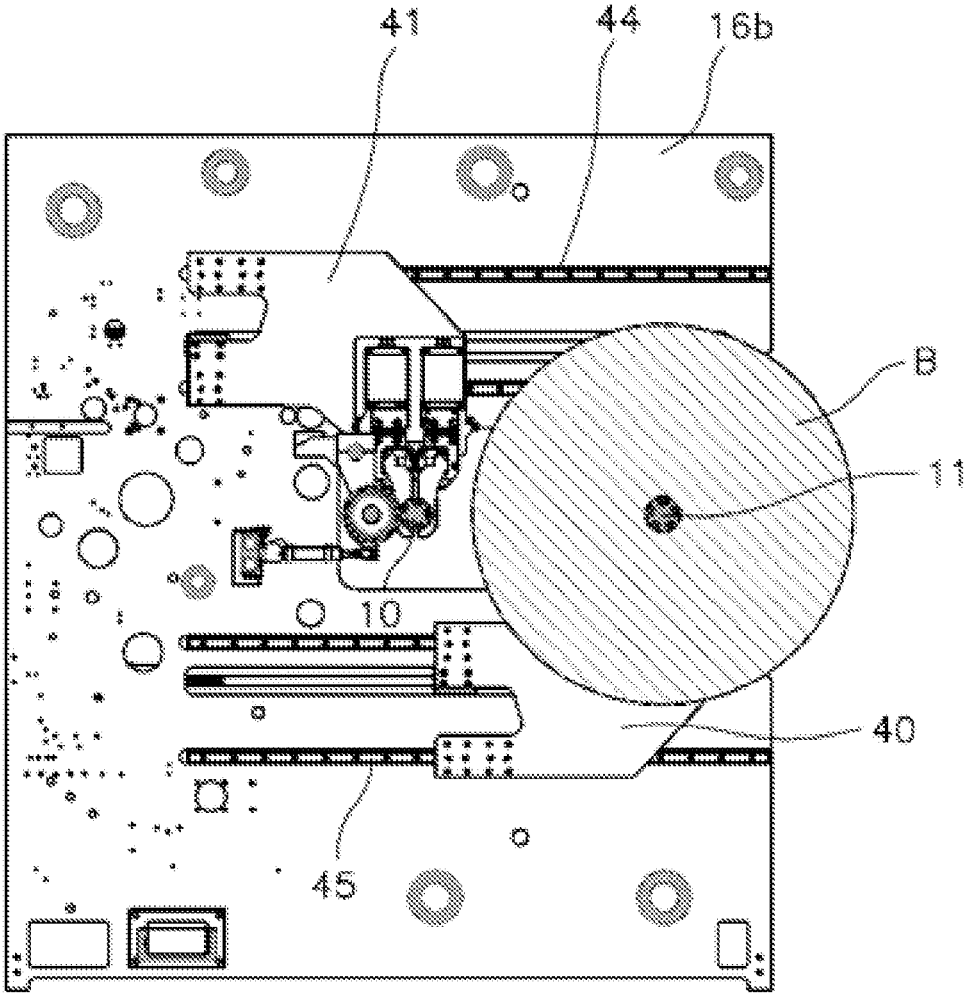
FIG. 3 is equivalent to the preceding figure but with the indication of a formed reel moving towards an unloading position.
Figure 4:
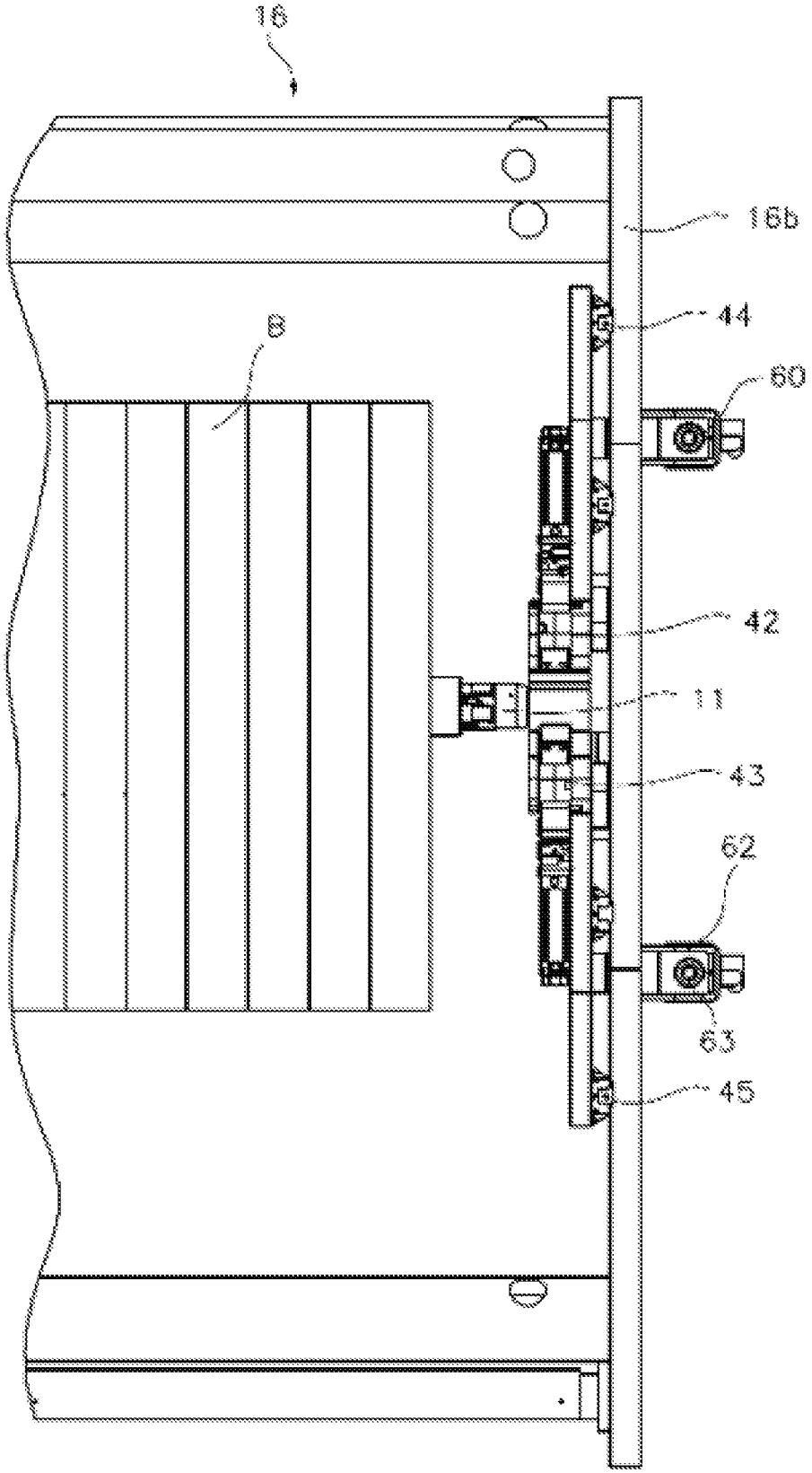
FIG. 4 is an enlarged partial elevational view of a sector of the framing where the ends of the winding shafts are supported and held.

As can be seen in FIGS. 2 to 4, one of the carriages 40 and its clamp device 42 are arranged above the winding shaft 10, whereas the second carriage 41 and its clamp device 43 are arranged below the second winding shaft 11, so there cannot be any interference at any time between the carriages and holding means during the linear movements thereof along the pairs of guides 44, 45.

The carriages 40, 41 are driven by systems of linear actuators and guides 60, 61, 62, 63 located on the outer face of said vertical wall 16*b*.

Each of the carriages 40, 41 has (see FIGS. 2 and 3) a carriage end section 40*a*, 41*a* bearing the clamp device 42, 43, inclined upwards and projecting towards the outer side of the wall 16*b* with respect to a carriage coupling section 40*b*, 41*b* for coupling with the pairs of guides 44, 45, such that at the end of the linear travel of the reel towards one of the sides (See FIG. 2, zone shown with a dotted line) the reel is arranged in a zone from which it can be extracted by conventional means (for example by means of a lifting platform) and removed without the wall 16*b* being an obstacle.

Figure 6:
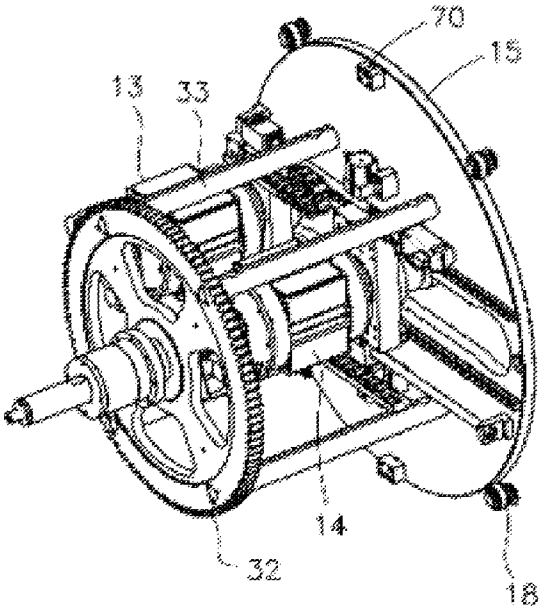
FIG. 6 is a partial perspective view of the rotational assembly supported in said part of the framing shown in FIG. 5.
Figure 5:
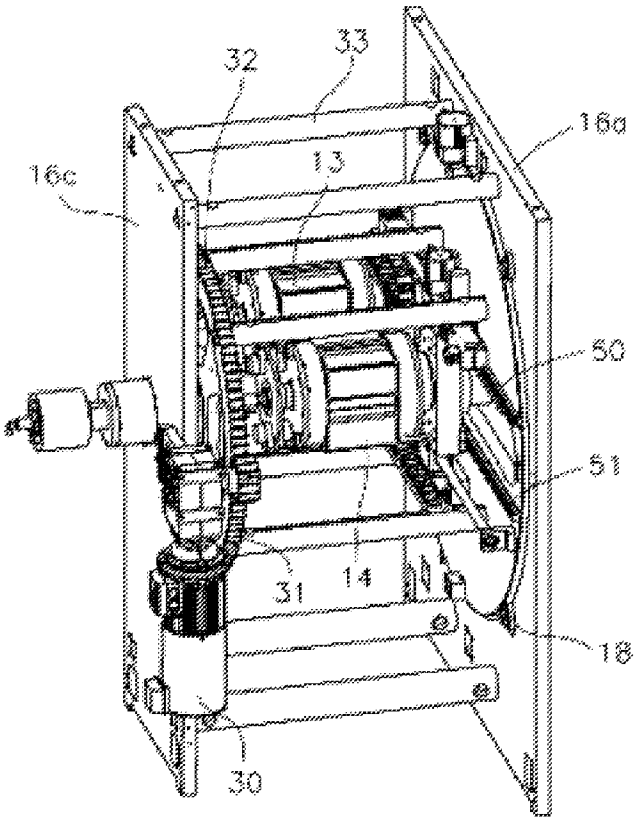
FIG. 5 is a perspective view of the section of the framing supporting the disc-shaped plate bearing the winding shafts and rotary drive servomotors.

As can be seen in FIGS. 5 and 6, said disc-shaped plate 15 bearing the servomotors 13, 14 and winding shafts 10, 11 is inserted partially in said circular opening 17 of the wall 16*a* of the framing 16 and rotationally supported on rolling elements 18 arranged along the periphery of said opening 17.

FIG. 6 shows the rotational turret structure supported between the walls 16*a* and 16*b* of the framing 16 and consisting of the disc-shaped plate 15 supported by the rolling elements 18 and which is integral by means of struts 33 with a gear wheel 32 rotationally supported (with the appropriate bearings) in a vertical wall 16*c* of the framing, parallel to the preceding walls 16*a* and 16*b*. Said gear wheel is in turn coupled to a gear of a transmission 31 driven by a geared motor 30, also supported on the wall 16*c*.

Figure 7:
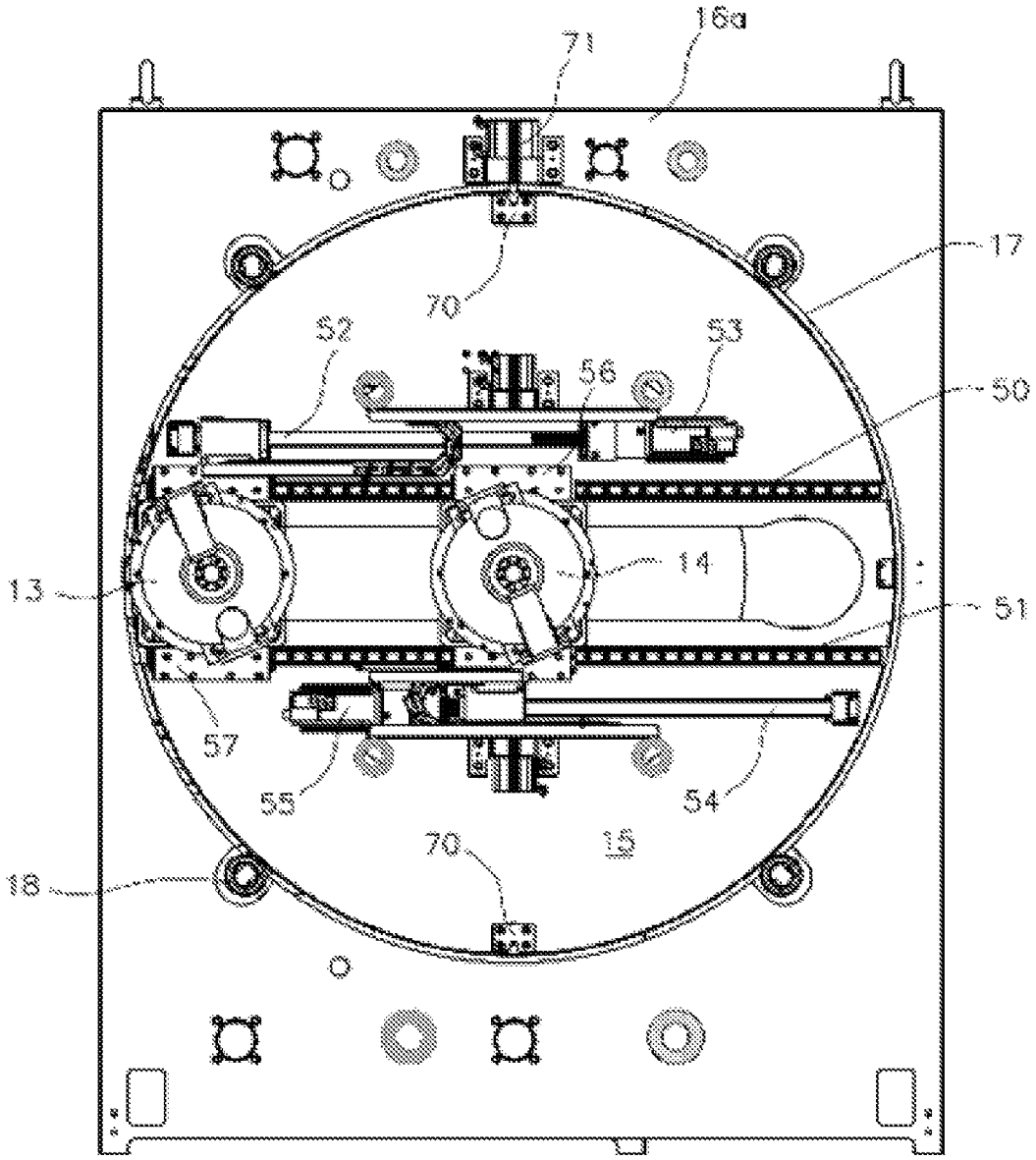
FIGS. 7 and 8 show an elevational view of the wall of the framing rotationally supporting the disc-shaped plate bearing the servomotors and the winding shafts.

FIGS. 6 and 7 show that the disc-shaped plate 15 includes elements 70 (for example a bridge part) at two diametrically opposed points of its periphery, and in the vertical wall 16*a* there are means 71 (driven by e.g. pneumatic actuators) that can be coupled with said elements 70, immobilizing the disc-shaped plate 15 in a very precise position suitable for effectively assuring the movement of the winding shafts in a horizontal plane.

When the disc-shaped plate rotates, the finished reel B on one of the winding shafts 10, 11 is arranged at the center of rotation of said disc-shaped plate 15 and turret or rotating assembly, held on the side opposite the drive by one of the clamp devices 42, 43. The other winding shaft 10, 11 is arranged at one end in its rewinding entry position and it rotates 180°, being arranged in cantilever fashion. Once said 180° rotation is made, the carriage with the open clamp devices 42, 43 moves to said empty shaft 10, 11, the clamp device 42, 43 closing to initiate winding and linear movement during the formation of the reel.

Figure 8:
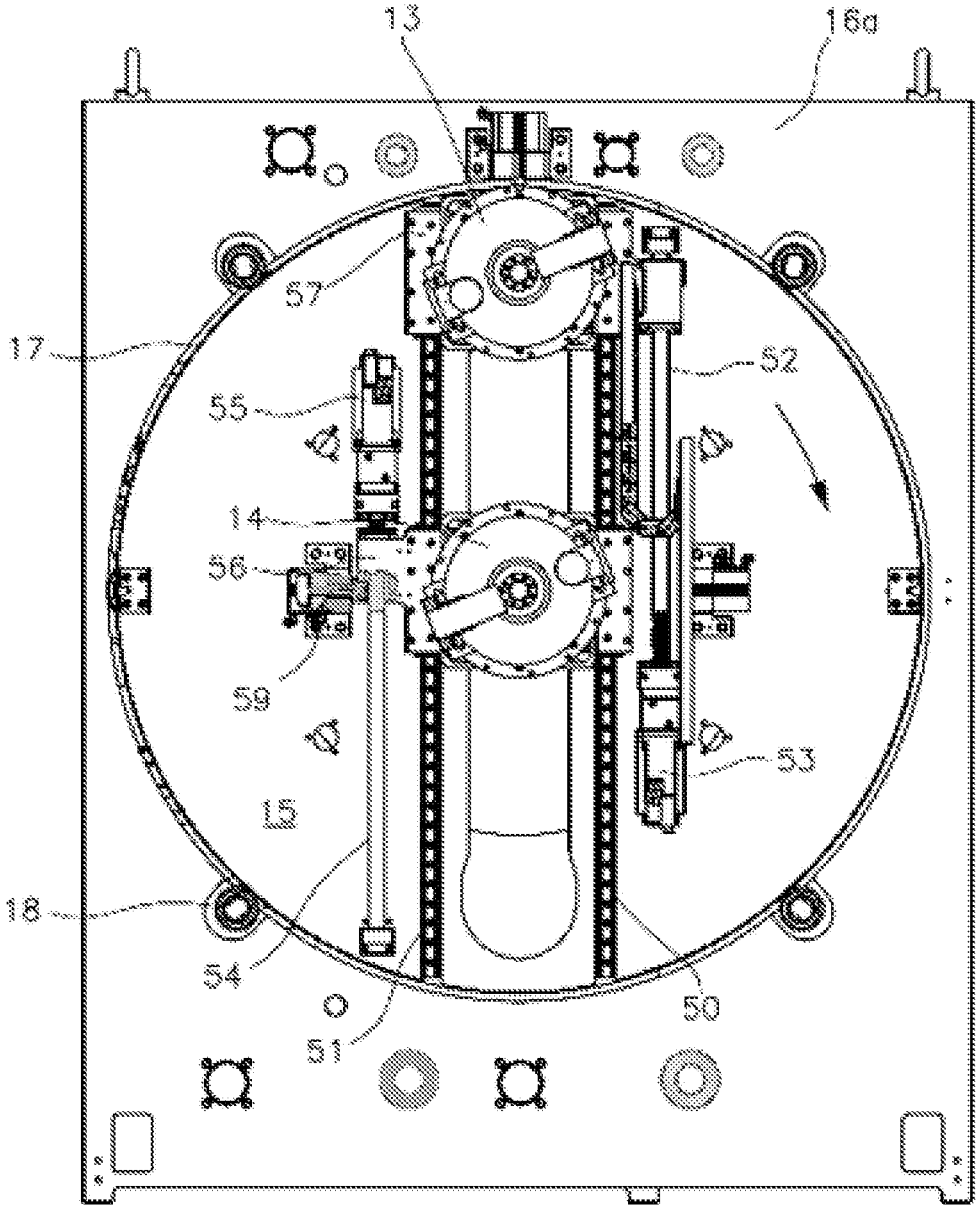

FIGS. 7 and 8 show the guide elements 50, 51 and drive elements 52, 53, 54, 55 (linear pneumatic actuator and guide in each case) for moving the rotary drive servomotors 13, 14 and winding shafts 10, 11 linearly. Said servomotors 13, 14 are arranged on carriages 56, 57 bearing the elements.

FIG. 8 shows a locking device 59 for locking one of said carriages 56, 57 while the disc-shaped plate rotates to move one of the winding shafts 10, 11 to a loading position as explained above, preventing the drive system for said carriage 56, 57 from having to withstand the weight of the reel in said conditions.

In the exemplified embodiment, said locking device 59 comprises a pneumatic actuator operating a pin that can be inserted in a cavity of the body of one of the carriages 56, 57.

The power supply and the pneumatic supply to the elements of the winding machine being described extends through the wall 16*c* of the framing 16 and the gear wheel 32 which has a central opening for such purpose, the struts 33 being useful as support elements for parts controlling and distributing power or compressed air (for example those installed in small cabinets).

The invention can be implemented using different devices which a person skilled in the art will consider as being equivalent for performing the exemplified functions.

The invention claimed is:

1. A revolver-type winding machine for web material which comprises:

two parallel first and second winding shafts each of which is provided with an independent rotary drive device connected directly to a first end of a corresponding one of the first or second winding shafts;

a disc-shaped support plate bearing said rotary drive means and first and second winding shafts, the first and second winding shafts being arranged perpendicular to said disc-shaped support plate, the disc-shaped support plate being rotationally supported with respect to a circular opening of a first vertical wall of a framing;

rotary drive means for causing said disc-shaped support plate to rotate about a horizontal axis centrally arranged with respect to the disc-shaped support plate to alternately arrange the first and second winding shafts in a loading position next to a web material supply source;

guiding means and drive means for moving said rotary drive devices and first and second winding shafts linearly along said disc-shaped support plate in a plane perpendicular thereto and passing through its a center of the disc-shaped support plate; and support structures for supporting a second end of each of said first and second winding shafts during at least part of the linear movement thereof along the disc-shaped support plate and during the formation of a reel on each of them, said support structures being supported on a second vertical wall of said framing, opposite said first vertical wall;

wherein:

said support structures comprise first and second carriages that can move linearly along parallel first and second pairs of guides fixed on said second vertical wall, said first and second carriages bearing selectively releasable first and second clamp means which keep said second ends of the first and second winding shafts held in a horizontal plane coplanar with said plane perpendicular to said disc-shaped support plate at all times during the formation of a reel on any one of said first and second winding shafts;

said first and second pairs of guides and first and second carriages are located on an inner face of said second vertical wall of the framing, directly facing the second ends of the first and second winding shafts;

the first carriage is arranged above the first winding shaft and has a first carriage coupling section coupled with the first pair of guides and a first carriage end section bearing said first clamp means, said first carriage end section being inclined downwards and projecting towards an outer side edge of the second vertical wall with respect to said first carriage coupling section; and the second carriage is arranged below the second winding shaft and has a second carriage coupling section coupled with the second pair of guides and a second carriage end section bearing the second clamp means, said second carriage end section being inclined upwards and projecting towards said outer side edge of the second vertical wall with respect to said second carriage coupling section.

2. The winding machine according to claim 1, wherein the first and second carriages are driven by systems of linear actuators and guides located on an outer face of said vertical second vertical wall.

3. The winding machine according to claim 1, wherein each of the first and second clamp means has autonomous pneumatic drive means.

4. The winding machine according to claim 1, wherein the disc-shaped support plate is inserted partially in said circular opening of the first vertical wall of the framing and rotationally supported on rolling elements arranged along the periphery of the circular opening.

5. The winding machine according to claim 4, wherein the disc-shaped support plate has retention elements at two diametrically opposed points of its periphery, and in the first vertical wall of the framing there are retaining means that can be coupled with said retention elements for immobilizing the disc-shaped support plate in a position suitable for the movement of the first and second winding shafts in said horizontal plane.

6. The winding machine according to claim 1, wherein the disc-shaped support plate is integrally attached by means of struts to a gear wheel rotationally supported on a third vertical wall of the framing, said third vertical wall being parallel to the first and second vertical walls, and said gear wheel being coupled to a gear of a transmission driven by a geared motor.

7. The winding machine according to claim 6, wherein power supply and pneumatic supply to elements of the machine extend through the vertical third wall of the framing and through a central opening of the gear wheel.

8. The winding machine according to claim 1, wherein said means for linearly moving said rotary drive devices and first and second winding shafts comprise said first and second carriages bearing the rotary drive devices and first and second winding shafts, said first and second carriages being both driven along common guiding means by linear actuators.

9. The winding machine according to claim 8, wherein locking means have been provided for locking at least one of said first and second carriages while the disc-shaped plate rotates to move one of the first and second winding shafts to said loading position while the formed reel is in a central position.

10. The winding machine according to claim 9, wherein said locking means comprise a pin that can be inserted in a cavity of one of the first and second carriages.

11. The winding machine according to claim 1, wherein said rotary drive devices of the first and second winding shafts are selected between a servomotor or an alternating current asynchronous motor with an associated winding for the direct drive of the corresponding first and second winding shaft.

* * * * *